United States Patent [19]

Beringer et al.

[11] 4,164,948

[45] Aug. 21, 1979

[54] METHOD FOR MAKING ARTIFICIAL TOBACCO AND APPARATUS FOR PERFORMING SAID METHOD

[75] Inventors: Monique Beringer, Saint Louis, France; Heinz Spörri, Zürich, Switzerland

[73] Assignee: Tamag Basel AG, Birsfelden, Switzerland

[21] Appl. No.: 762,129

[22] Filed: Jan. 24, 1977

[30] Foreign Application Priority Data

Jan. 23, 1976 [LU] Luxembourg ..... 74233

[51] Int. Cl.[2] ..... A24B 3/14

[52] U.S. Cl. ..... 131/140 C; 131/2; 131/17 AC

[58] Field of Search ..... 131/17, 15 C, 140 R, 131/140 C

[56] References Cited

U.S. PATENT DOCUMENTS

| | | | |
|---|---|---|---|
| 2,845,933 | 8/1958 | Samfield et al. | 131/140 C |
| 3,709,232 | 1/1973 | Lilja et al. | 131/140 C |
| 3,894,544 | 7/1975 | Egri | 131/140 C |

*Primary Examiner*—Robert W. Michell
*Assistant Examiner*—V. Millin
*Attorney, Agent, or Firm*—Hubbell, Cohen, Stiefel & Gross

[57] ABSTRACT

Method for making artificial tobacco. Comprises preparing a homogenous composition from finely divided plant material and additives, this composition having a moisture content of from about 20 to 50 percent by weight, forming said composition into strand sections and rolling down said strand sections between squeeze rollers, operating at different relative speeds of rotation. An apparatus for performing such method is also disclosed.

12 Claims, 7 Drawing Figures

METHOD FOR MAKING ARTIFICIAL TOBACCO AND APPARATUS FOR PERFORMING SAID METHOD

BACKGROUND OF THE INVENTION

A method for making artifical tobacco is described in U.S. Pat. No. 3,302,432, wherein a continuous strand, having a thickness corresponding to that of tobacco filaments for cut tobacco, is introduced between squeeze rollers rotating at a substantially higher speed than rollers to the rear of the strand, so that the strand is forcibly pulled by the squeeze rollers and torn into sections. This method requires very small extrusion dies which are subject to substantial wear, while permitting only an uneconomically small throughput and requiring the employment of desanded plant material. Also, the dimensions of the produced tobacco filaments are subject to numerous variations, which is disadvantageous inasmuch as the filaments cannot be post-treated so as to alter their dimensions. It is also difficult to mix the finished filaments with other filaments, for instance those of natural tobacco.

The present invention provides a method whereby the artificial tobacco produced is obtained in a form in which it may be further processed industrially by the same processing techniques as are applied to the processing of natural tobacco leaves.

SUMMARY OF THE INVENTION

In accordance with the present invention, a homogenous moist composition is prepared from finely divided plant material and appropriate additives, this composition preferably having a moisture content of from about 20 to 50 percent by weight. This composition is then formed into strand sections that are substantially equal in length. These strand sections are then extended in size, by rolling down between squeeze rollers which operate at different relative speeds of rotation. The resultant rolled down strand sections are subsequently cured by drying.

BRIEF DESCRIPTION OF THE DRAWINGS

The invention will be best understood in conjunction with the accompanying drawings, wherein FIG. 1 (which includes 1A and 1B) is a flow diagram illustrating the method of the invention.

DESCRIPTION OF THE PREFERRED EMBODIMENTS

Figures 1A, 1B:
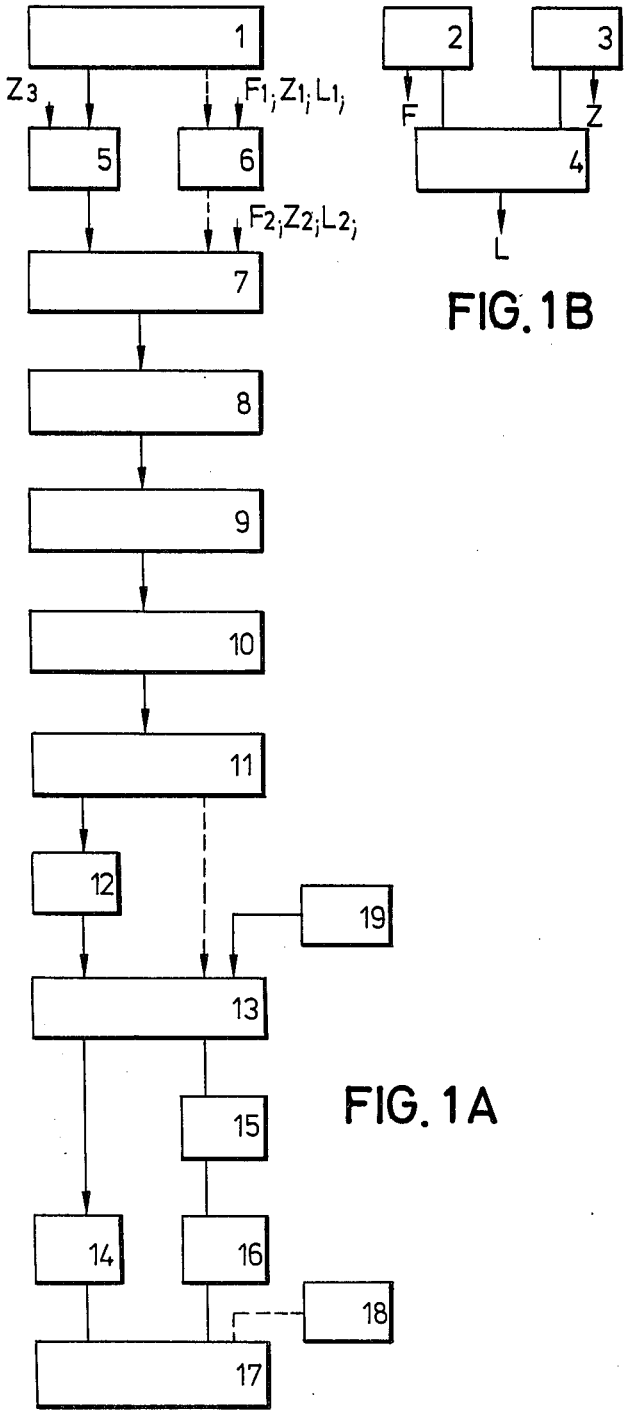

In accordance with this invention, the composition is prepared so as to have a moisture content of from about 20 to 50 percent by weight, and preferably from about 35 to 50 percent by weight. Such composition is kneaded at an excess pressure of from about 50 to 150 atmospheres and is extruded to one or more uniform strands. These strands, immediately upon being formed, are continuously and periodically divided into sections of substantially equal length. The amount of artificial tobacco contained in said sections corresponds to a predetermined value, within the range of from about 0.1 to 2.0 grams, within a tolerance of plus or minus 10 percent. The strand sections are immediately and individually rolled down so as to form individual artificial tobacco strips having a surface area of between about 8 and 100 sq.cm, by passage between squeeze rollers rotating at different circumferential speeds and being urged out of mutual linear engagement of their circumferential surfaces by the strand sections entering therebetween, so as to form a narrow nip of predetermined width. The width of said nip is so selected that the rolled-down strand sections have a predetermined thickness in the range of 0.1 to 1 mm, with a maximum tolerance of plus or minus 10 percent.

Inasmuch as the artificial tobacco strips produced according to the invention are rolled down from uniformly dimensioned strand sections, the strips themselves will also have uniform dimensions. The artificial tobacco strips have approximately the same surface area and the same thickness as strips from natural tobacco leaves obtained by "de-ribbing" untreated or tipped natural tobacco leaves. The artificial tobacco strips produced according to the invention may therefore be further processed by the same techniques as are used with strips from natural tobacco leaves. They also may readily be mixed with strips from natural tobacco leaves.

The method of this invention requires only a relatively low moisture content in the composition in order that it be formed into strands, so that considerable energy is saved during subsequent drying. Since the strands are divided into sections while still soft, wear of the dividing means is minimized.

Dividing of the strand is preferably performed by a blade moving periodically and in close proximity over the respective die outlet. It is also possible to avoid the use of mechanical dividing means such as a blade or the like, as by employing pressurized gas jets to divide the strand into sections. The different circumferential speeds of the squeeze rollers results in the strand sections always adhering to only one squeeze roller, namely, that rotating at the higher speed, from which they can be readily removed due to their low degree of adherence, which in turn results from their relatively low moisture content.

Experience has shown that during the rolling down of the strand sections it is easier to extend them in the direction of feed rather than transversely thereof. In order that the finished artificial tobacco strips do not become extremely long and narrow, it is preferred to form the strand sections with a maximum length of from about 20 to 90 mm, and to feed them to the nip between the squeeze rollers with their maximum dimension extending parallel to the squeeze roller axes. It is also preferred to feed the strand sections to the squeeze roller nip in the direction of movement of the strand. If the maximum dimension of the strand sections is obtained by the distance between consecutive divisions, it is preferred to rotate the strand sections by 90° about an axis transverse to their length, so that they will be fed to the squeeze roller nip in the direction of movement of the strand with their maximum dimension extending parallel to the squeeze roller axis.

In order to obtain a high filling capacity, a wavy or curly configuration of the artificial tobacco is desirable. According to the invention, such configuration may be obtained by providing that the artificial tobacco mass making up the strand section (which section is to be introduced between the squeeze rollers) be unevenly distributed in a direction parallel to the squeeze roller axis, so that an intermediate area or several intermediate areas contain a smaller amount of the composition than the adjacent areas on both sides thereof. Artificial tobacco filaments cut from artificial tobacco strips produced in such a manner have a particularly advantageous curly configuration.

Artificial tobacco leaves should not be softened or dissolve under the action of moisture. Such undesirable softening or dissolution may be avoided by the addition of suitable binding and/or stabilizing agents. According to the invention, it is also possible to increase the resistance of artificial tobacco strips against the action of moisture by drying the rolled-down artificial tobacco strips below the usual moisture content (which is 10 to 14 percent by weight) required for further processing and storing. Thus, they may be dried down to a moisture content of about 1 to 4 percent by weight, and may subsequently be remoistened to a moisture content of 10 to 14 percent for further processing.

The invention also relates to an apparatus for forming artificial tobacco portions from a homogenous artifical tobacco composition adapted to be rolled-down to artificial tobacco strips, which apparatus is suitable for performing the method of this invention. Thus, this invention also provides an improved apparatus for producing in a simple manner, substantially uniformly dimensioned artificial tobacco portions of substantially uniform weight.

The apparatus of the invention comprises an extruder press having one or more extrusion dies of equal dimensions, with the smallest opening width in the range of from about 0.4 to 2 mm and the greatest opening width in the range of from about 10 to 90 mm, said dies being adapted to have a continuous strand of an artificial tobacco composition extruded therefrom at a uniform rate. At the outlet side of said extrusion dies there are provided sectioning means for periodically sectioning the strands issuing from said dies into uniform strand sections. Each die is adapted to determine the exact dimensions of a strand issuing therefrom, so that the amount of the composition contained in one strand section depends solely on the length thereof. With the apparatus of the invention, the sectioning of the strand into sections of consistently the same length does not present any problems, so that such sections will always contain the same amount of artificial tobacco, as desired.

The apparatus of the invention makes use of the fact that the sectioning means, such as blades or pressurized gas jets, will always engage the still soft strand as long as the portion thereof provided to be separated is still retained by the extrusion due, so that it may not be thrust aside in spite of its soft consistency. Under these circumstances if knives are used as the sectioning means, they need not be extremely sharp and are therefore subject to little wear, since they only penetrate the soft material of the strand.

The invention will be further described with reference to the accompanying drawings. As schematically illustrated in FIG. 1, the method comprises the step of providing plant material 1, a liquid 2, and additives 3.

The liquid may be water or an organic solvent. Suitable organic solvents include, for example, alcanes and halogen-substituted alcanes, such as methylene chloride; and monohydric alcohols, such as methanol, ethanol and isopropanol; dihydric alcohols, such as diethylene glycol, 1,2-propylene glycol, triethylene glycol and 1,3-butylene glycol; and polyhydric alcohols, such as sorbitol.

The plant material preferably comprises threshing residues, such as straw or bran or chaff of wheat, oats, rice, and maize, or of fibers and shells of coconuts, coffee beans and cocoa beans. In addition to the above referred to nicotine-free plant materials or in lieu thereof, the plant material employed may comprise tobacco plants or parts thereof as well as tobacco residues from the tobacco processing industry.

The additives preferably include one or more binders such as sodium carboxy methyl cellulose, acetyl cellulose, ethyl cellulose, hydroxy propyl methyl cellulose, hydroxy ethyl methyl cellulose, or the like; burning aids, such as magnesium formate; plasticizers, such as glycerine; aromatizing agents, such as paraffin urea; brighteners, such as citric acid; moisture stabilizers, such as glyoxal; and adsorption materials, such as meerschaum.

The liquid 2 and the additives 3 may be added separately of, if the additives are soluble in the liquid, in the form of a solution as at 4. In the flow diagram, the liquid 2 is designated F, the additives are designated Z, and the added solution is designated L. The portions of these materials added at various stages are further designated by the reference indexes 1, 2, and 3, e.g., F1, L2, Z3, etc.

The solid lines in the flow diagram (FIG. 1) show a preferred method, whereas alternative embodiments are shown by dashed lines.

In the preferred embodiment, the plant material 1 is dry ground as at 5, or alternatively wet ground as at 6. It is also possible to dry grind a portion of the plant material and to wet grind another portion thereof, for instance, when using delicate plant materials. For dry grinding, any additives that have to be ground which are not soluble in the liquid may be added, as at Z3. For wet grinding, a part or the entire amount of the liquid is added, as at F1. It is also possible to simultaneously add the additives Z1 or to add the solution L1.

Subsequently, the dry ground and/or wet ground material is thoroughly mixed with all the required additives and the full amount of liquid, as at 7. As a result of the moderate amount of liquid used, the obtained mixture has a crumbly, flowable consistency. The uniformly moistened mixture is then kneaded, as at 8, and condensed to a homogenous mass, which is then compressed for at least 5 seconds by a constant pressure of, for example, 80 atmospheres, as at 9. By the application of this pressure, the kneadable mass is formed into strands by extrusion through dies, as at 10. At 11, the strands are divided into equal sized strand sections, which in the preferred embodiment are then individually pre-dried as at 12, before being rolled down to individual artificial tobacco strips, as at 13. Predrying, as at 12, is not essential, however. The rolled down artificial tobacco strips are then dried to a moisture content of 10 to 14 percent by weight, as at 14, and are thereby cured to a unitary flexible state. The finished artificial tobacco strips are then further processed, as at 17, e.g., as by the addition of further tobacco strips, as at 18. The latter strips may be artificial or natural tobacco strips, or a mixture thereof.

Alternatively, the artificial tobacco strips obtained at 13 may be further dried, as at 15, to a moisture content of as little as 1 to 1.5 percent by weight, and are subsequently remoistened to a moisture content of 10 to 14 percent by weight, as at 16, so as to restore their flexibility. Further processing of the remoistened tobacco strips may then proceed as described at 17.

As a further alternative, the strand sections may be sprinkled on one side or both sides with finely ground dry plant material, as at 19, before being fed to the squeeze roller nip, so that said plant material is rolled into the artificial tobacco strips.

Wet grinding, as at 6, may be performed with a wet grinding mill, e.g., as described in U.S. Pat. No. 3,605,757. For dry grinding, as at 5, a conventional disc grinding mill may be employed.

Figure 2:
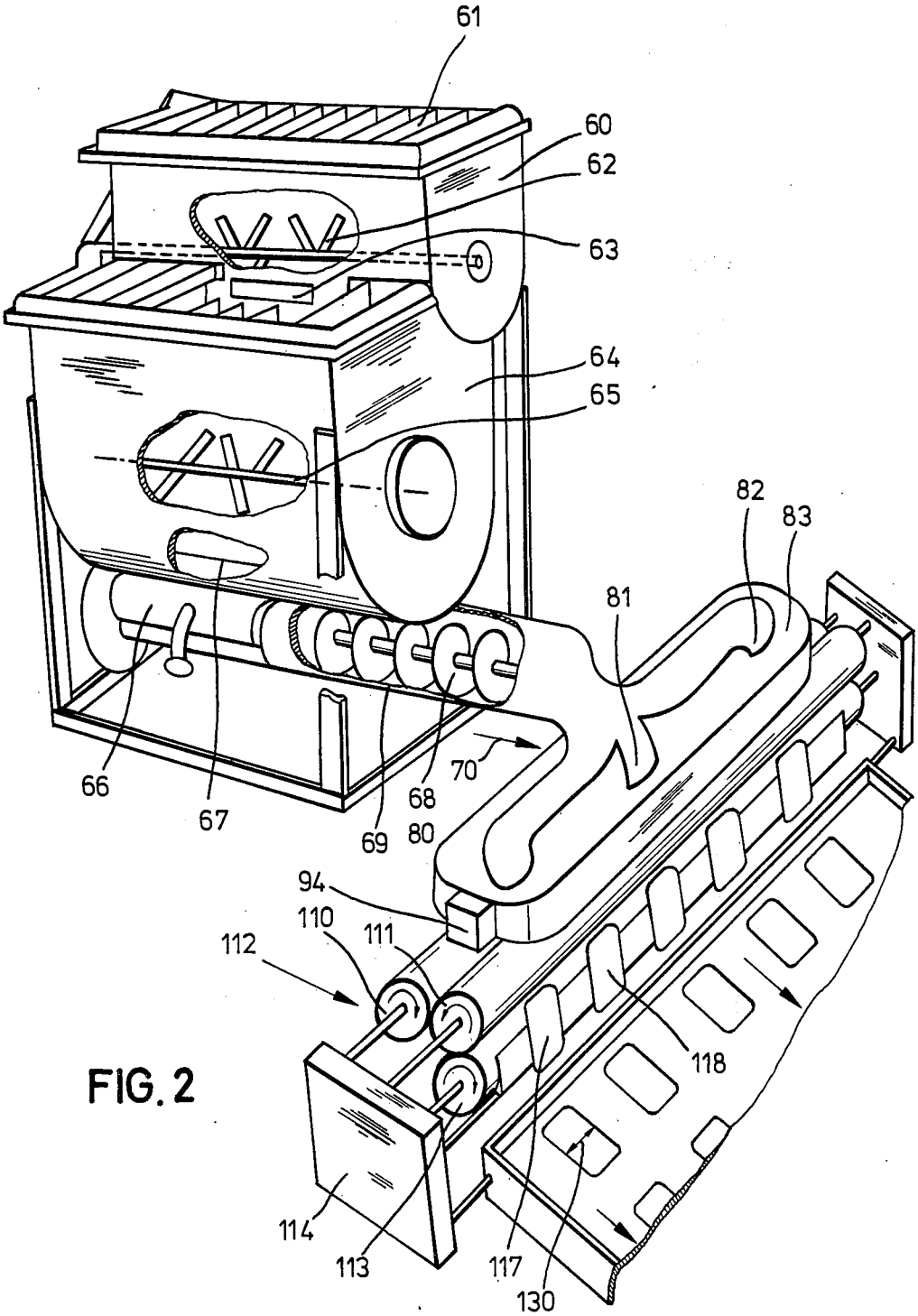
FIG. 2 is a partially sectioned perspective view of a two-stage mixing and stirring apparatus preceding an extruder press, followed by a squeeze roller assembly and a discharge conveyor means.

FIG. 2 shows an apparatus for performing steps 7 to 13 of FIG. 1, i.e., mixing and kneading of the ground materials, extruding strands thereof, dividing the strands into sections, pre-drying of the strand sections, and rolling the sections down to form artificial tobacco strips.

FIG. 2 shows a first mixing trough 60 covered by a grid 61 through which the ground material, the liquid, and the additives may be introduced with the aid of metering balances or metering pumps. The ground material is mixed by a rotating mixer shaft 62 and falls through a slot 63, the opening of which may be adjusted by a slide damper (not shown), into a second mixing trough 64, in which it is further mixed by a rotating mixer shaft 65. Through a slot 67, the opening of which is manually adjustable by means of a slide damper 66, the mixture then falls down towards a rotating compression screw 68 supported in a cylindrical barrel 69. From barrel 69, three conduits 80, 81, 82 lead to an extruder head 83, the underside of which is closed by a horizontally disposed elongate die plate 84 (FIG. 4).

Figure 4:
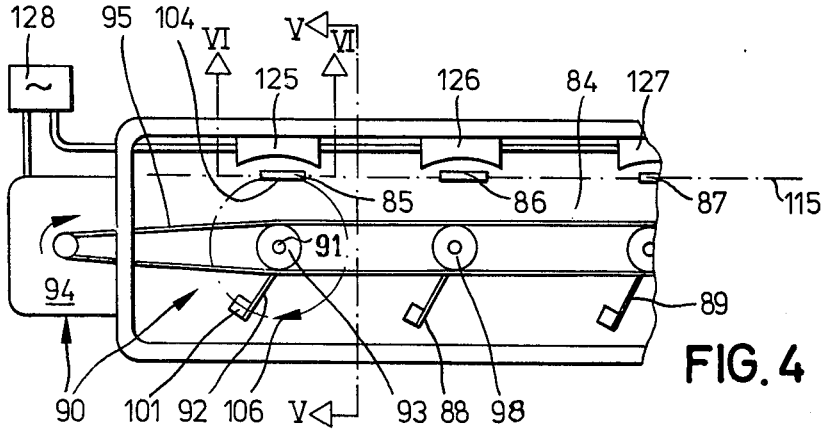
FIG. 4 is a bottom view of the extruder head of the extruder press of FIG. 2, in the direction towards the extrusion dies, and in an enlarged scale.

Distributed along the length of the die plate 84 are a total of six dies, three of which are shown in FIG. 4 and designated 85, 86 and 87. The dies are of identical design and have a rectangular passage, desirably measuring 0.8 mm by 30 mm.

The compression screw kneads the moistened mass and feeds it under increasing pressure in the direction of arrow 70 towards the die plate 84. By this action, the mass is continuously compacted. In the forward portion of the barrel 69, the conduits 80, 81 and 82 and in the die head 83, the mass is subjected to a pressure of about 80 atmospheres for about one minute, until the mass is extruded from the dies in the form of individual soft strands of rectangular cross section.

Figure 5:
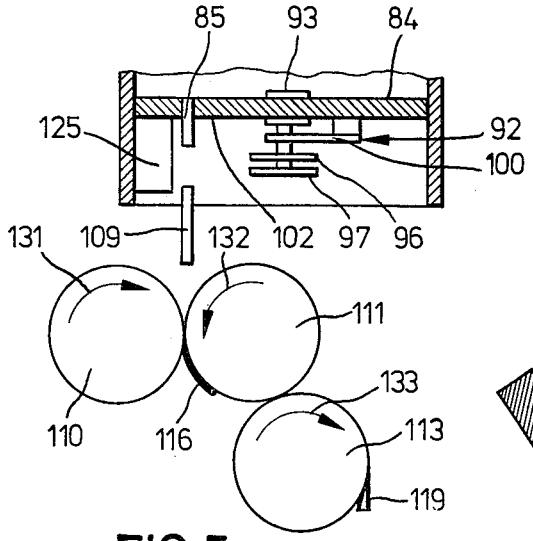
FIG. 5 is a sectional view of the extruder head and of the squeeze rollers of FIG. 2, taken along the line V—V in FIG. 4.

A separating means generally designated 90 (FIG. 4) serves to divide the strands emerging from the dies into strand sections of equal length. Associated with die 85, the separating means 90 has a knife 92 adapted to be rotated about a shaft 91. The shaft 91 is rotatably supported in the die plate 84 by a bearing 93 and is operatively connected to an electric drive motor 94 attached to one side of the extruder head through a driving chain 95 and a sprocket 96 (FIG. 5). The shaft 91 carries a further sprocket 97 (FIG. 5) drivingly connected to the shaft 98 of the next knife 88, and so onwards, so that all knives 92, 88, 89 . . . , are rotated synchronously in operation.

Figure 6:
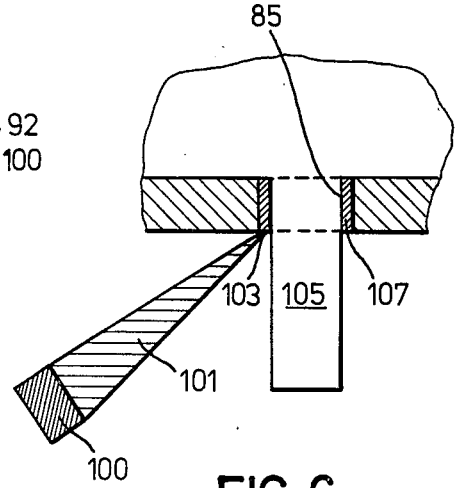
FIG. 6 is a further enlarged scale of a sectional view, taken along the line VI—VI in FIG. 4, of a strand section being discharged from an extrusion die, with a knife blade posed for cutting of the strand section.

Affixed to the haft 100 of knife 92 is a knife blade 101 having a flat shape and being inclined with respect to the outer surface 102 of die plate 84 (FIGS. 4–6). The edge 103 of knife 92 is straight and slides on the flat outer surface 102 of die plate 84 during rotation of the knife in the direction of arrow 106. During each rotation, knife edge 103 passes over the opening 104 of die 85, so as to separate a strand section from the strand 105 emerging from said die. The inclination of knife blade 101 enables the succeeding strand portion to emerge from opening 104 of die 85 without hindrance by blade 101 while the knife edge penetrates the strand. The knives 88, 89 . . . , provided for the other dies are designed and operated in a similar manner.

Each die is desirably lined with a plastic insert, one such insert for die 85 being shown in FIG. 6 and designated 107. Alternatively, the dies may be formed in a single common plastic insert.

As shown in FIG. 5, the separated strand sections 109 fall vertically downwards into the nip of two squeeze rollers 110, 111 of a squeeze roller assembly generally designated 112 (FIG. 2). Rollers 110, 111, and 113 are rotatably supported in assembly 112 with their axes extending horizontally and parallel to one another, and are rotated by a common drive source 114 (FIG. 2) in the direction of arrows 131, 132 and 133, respectively. Rollers 110, 111, and 113 have outer surfaces of stone or of steel and extend over the length of the row of dies 85, 86, 87 . . . . The nip of rollers 110 and 111 extends vertically below the center of the horizontal row 115 of dies. Roller 110 is rotated at a circumferential speed V110, which is somewhat lower than the circumferential speed V111 of roller 111. Therefore, as shown in FIG. 5, the strand section 116 rolled down between rollers 110 and 111 will adhere to the periphery of the faster rotating roller 111 to be carried into the nip of rollers 111 and 113, where it is further rolled down to the final shape of an artificial tobacco strip. The circumferential speed of roller 113 is somewhat higher than that of roller 111. In this manner, each strand section is formed into an artificial tobacco strip adhering to the periphery of roller 113.

Figure 3:
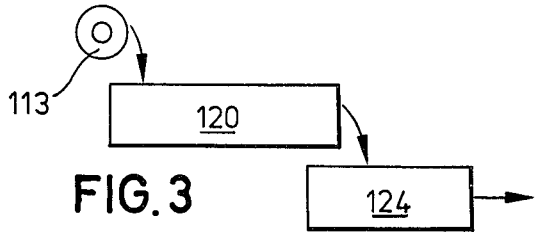
FIG. 3 schematically illustrates the discharge conveyor means of FIG. 2, with a turbulence dryer at the discharge end thereof.

As shown in FIGS. 2, 3, and 5, these tobacco strips 117, 118 are detached from roller 113 by a blade 119 engaging the periphery thereof and fall onto the upstream end of a heatable vibration conveyor 120. Conveyor 120 feeds the still moist artificial tobacco strips to an air or microwave heated turbulence dryer 124, in which they are dried to a moisture content of 10 to 14 percent, as at 14 in FIG. 1.

For the pre-drying step, as at 12, in FIG. 1, individual electric microwave heaters 125, 126, 127 . . . are provided adjacent dies 85, 86, 87 . . . , said heaters being energized from a common current source 128 for heating the strands emerging from dies 85, 86, 87 . . . and thus drying them superficially. Alternatively, the microwave heaters 126, 126, 127 . . . may be replaced by one or more hot air blowers.

During the rolling down of the strand sections to artificial tobacco strips they should not contact one another, so as to prevent the strips sticking together. To this end, the adjacent strand sections are fed to the nip of rollers 110, 111 with a mutual interstice corresponding to the distance between the dies in the axial direction of the rollers, said distance being somewhat larger than the width 130 of a finished strip 117. In this manner, it is assured that a minimum axial distance exists between adjacent strips adhering to the roller periphery.

In order to prevent consecutively fed strand sections from contacting one another in the roller assembly, the squeeze rollers are rotated at a circumferential speed which is at least somewhat higher than the extrusion speed of the strands at the dies, multiplied by the elongation factor, by which each strand section is elongated in the circumferential direction of the rollers while being rolled down. In this manner, it is assured that consecutively formed strips do not contact one another while adhering to the rollers.

According to the invention, it is possible to impress finely ground substances such as meerschaum as an adsorption agent, natural tobacco dust or the like, into the formed artificial tobacco strips. To this effect there may be provided a sprinkler device (not shown) for feeding metered amounts of such powdered materials to the nip of rollers 110 and 111, together with the strand sections.

The die plate 84 and/or the squeeze rollers 110, 111, and 113 are preferably provided with heating and/or cooling devices for maintaining these parts at the optimum temperature during operation.

In the following illustrative examples, the method is carried out in accordance with the flow diagram of FIG. 1. All parts are by weight unless otherwise stated. In each example, the amounts of materials are set forth for an individual charge. In practice, however, the method is preferably carried continuously, rather than batchwise. In the continuous process, the components are employed in the ratios set forth in the examples.

EXAMPLE 1

Preparation of the mixture: 2.4 kg Virginia tobacco plants, 1.6 kg tobacco scraps from cigarette manufacture, and 600 g meerschaum were dry ground together in a disc grinding mill to a maximum particle size of 1 mm. 200 g sodium carboxy methyl cellulose, 80 g citric acid, and 320 g glycerine were dissolved in 1.8 liters of water, and the solution was added to the ground material. By thorough mixing there was obtained a homogenous, flowable, crumbly mixture having a moisture content of 30.3 percent by weight. The mixture was kneaded and thereby compacted to a homogenous mass.

Shaping of the mass: For at least five seconds the mass was subjected to a pressure of 80 atmospheres while being extruded through extrusion dies in the form of uniform strands. The cross sectional area of each strand equaled that of the respective die opening, measuring 1.2×30 mm in each case. The strands were continuously divided into sections having a length of 20 mm each. The resulting strand sections had a weight of 0.6 g within a tolerance of 8 percent. The strand sections were pre-dried to a moisture content of about 27 percent, and were then rolled down to individual artificial tobacco strips. The resulting strips had a surface area of 30 sq. cm within a tolerance of 10 percent.

Finishing strips for storing: In a suspension or turbulence dryer, the strips were dried to a moisture content of 1 percent, and then remoistened in a moistening drum to a moisture content of 10 percent. The resulting artificial tobacco strips had a light brown color and were suitable for storage.

EXAMPLES 2–6

Preparation of mixture: As in Example 1.

Shaping of mixture and Finishing for storage: As in Example 1, with modifications as set forth in the Table, hereinafter.

EXAMPLE 7

Preparation of mixture: 3.2 kg burley tobacco plants, 600 g meerschaum and 200 g sodium carboxy methyl cellulose were dry ground together in a disc grinding mill to a maximum particle size of 0.75 mm. 0.8 kg dusty cigarette tobacco wastes were wet ground together with 2.4 liters of water, 320 g glycerin and 80 g ammonium citrate, to form a homogenous slurry. The slurry was mixed with the dry ground materials to form a homogenous, flowable, crumbly mixture having a moisture content of 35.8 percent. The mixture was kneaded and thereby compacted to a homogenous mass.

Shaping of mixture and Finishing for storage: As in Example 1, with modifications as set forth in the Table.

EXAMPLE 8

Preparation of mixture: 3.0 kg winnower stems and 720 g meerschaum were dry ground together in a disc grinding mill to a maximum particle size of 0.8 mm. 2.0 kg tobacco scraps, 6.9 liters of water, 300 g sodium carboxy methyl cellulose, 80 g citric acid and 350 g sorbitol at 70 percent were wet ground to form a homogenous slurry. The slurry was added to the dry ground material together with 43 g magnesium formate. Thorough mixing resulted in a homogenous, flowable, crumbly mixture having a moisture content of 50 percent. The mixture was kneaded and thereby compacted to form a homogenous mass.

Shaping of mixture and Finishing for storage: As in Example 1, with modifications as set forth in the Table.

EXAMPLE 9

Preparation of the mixture: As in Example 8.

Shaping of mixture and Finishing for storage: As in Example 1, with modifications as set forth in the Table.

EXAMPLE 10

Preparation of the mixture: 5.0 kg Brazil tobacco leaves, ground to a maximum size of 1 mm, were mixed with 750 g meerschaum ground to a maximum particle size of 0.15 mm. 3.5 liters of water, 100 g magnesium formate, 100 g citric acid, 250 g of a 40% solution of glyoxal, 400 g glycerin and 300 g sodium carboxy methyl cellulose were thoroughly mixed and added to the dry ground materials. Thorough mixing resulted in a homogenous, flowable, crumbly mixture having a moisture content of 40.4 percent. The mixture is kneaded and thereby compacted to form a homogenous mass.

Shaping the mixture and Finishing for storage: As in Example 1, with modifications as set forth in the Table.

The artificial tobacco strips produced in accordance with this example had the typical Brazil aroma and were well suited for use as a filler in cigars and cigarillos.

EXAMPLE 11

Preparation of the mixture: 2.5 kg stems and 2.5 kg scraps from Maryland tobacco, together with 300 g methyl cellulose, were dry ground in a disc grinding mill to a maximum particle size of 0.9 mm. The ground materials were mixed with 3 liters of water, 300 g sorbitol at 70%, 100 g of a 40% glyoxal solution, and 100 g tartaric acid. Sorbitol and glyoxal were dissolved, or dispersed, respectively, in a fraction of the water to be added before being added to the dry material. Thorough mixing resulted in a homogenous, flowable, crumbly mixture having a moisture content of 38.6 percent. The mixture was kneaded and thereby compacted to form a homogenous mass.

Shaping the mixture and Finishing for storage: As in Example 1, with modifications as set forth in the Table.

The artificial tobacco strips produced had the typical Maryland aroma. They preferably are mixed with strips from natural tobacco leaves and then employed in the manufacture of cigarettes.

EXAMPLE 12

Preparation of the mixture: 5.0 kg dust of Orient tobacco having a particle size of less than 1.5 mm and 900 g meerschaum having a maximum particle size of 0.16 mm were mixed with a slurry consisting of 1.2 liters of water, 100 g citric acid, 125 g of a 40% glyoxal solution, 100 g magnesium formate, 300 g sodium carboxy methyl cellulose, 150 g glycerin and 150 g sorbitol at 70 percent. The mixture had a moisture content of 20.2 percent, and was then kneaded and thereby compacted to form a homogenous mass.

Shaping the mass and Finishing for storage: As in Example 1, with modifications as set forth in the Table.

The artificial tobacco strips produced in this manner had the typical Orient aroma. They are preferably employed, together with strips of natural tobacco leaves, in the manufacture of cigarettes.

EXAMPLE 13

Preparation of the mixture: 750 g wheat chaff, 170 g cocoa shells, 1250 g meerschaum and 570 g sodium carboxy methyl cellulose were dry ground together in a disc grinding mill to a maximum particle size of 1.0 mm. The ground material was mixed with 1.7 liters of water, 410 g calcium carbonate, 200 g magnesium formate, 50 g caffein, 120 g paraffin, 280 g molasses, 150 g diethylene glycol, and 50 g sugar coloring. The paraffin, the molasses, the diethylene glycol and the sugar coloring were dissolved in a fraction of the water and added to the ground material as a solution. Thorough mixing resulted in a homogenous, flowable, crumbly mixture having a moisture content of 40.3 percent. The mixture was kneaded and thereby compacted to form a homogenous mass.

Shaping of the mass and Finishing for storage: As in Example 1, with modifications as set forth in the Table.

EXAMPLE 14

Preparation of the mixture: 750 g wheat chaff, 170 g cocoa shells, 1250 g meerschaum, 510 g sodium carboxy methyl cellulose, 410 g calcium carbonate, 200 g magnesium formate, 1600 g dust of cigarette tobacco residues and 400 g stems of cigarette tobacco were dry ground together in a disc grinding mill to a maximum particle size of 1.0 mm. The ground material was mixed with 3.5 liters of water, 120 g paraffin, 280 g molasses, 150 g diethylene glycol, and 50 g sugar coloring. Thorough mixing resulted in a homogenous, flowable, crumbly mixture having a moisture content of 43.2 percent. The mixture was kneaded and thereby compacted to form a homogenous mass.

Shaping of the mass and Finishing for storage: As in Example 1, with modifications as set forth in the Table.

EXAMPLE 15

Preparation of the mixture: As in Example 14.

Shaping of the mixture and Finishing for storage: As in Example 1, with modifications as set forth in the Table.

EXAMPLE 16

Preparation of the mixture: 3.0 kg Virginia stems, 2.0 kg dust from cigarette tobacco wastes, 500 g meerschaum and 300 sodium carboxy methyl cellulose were dry ground together in a disc grinding mill to a maximum particle size of 0.9 mm. The ground material was mixed with 3 liters of water, 400 g glycerin, 100 g of a 40% glyoxal solution and 100 g citric acid. Thorough mixing resulted in a homogenous, flowable, crumbly mixture having a moisture content of 37.2 percent. The mixture was kneaded and thereby compacted to form a homogenous mass.

Shaping the mass and Finishing for storage: As in Example 1, with modifications as set forth in the Table.

EXAMPLE 17

Preparation of the mixture, Shaping of the mass, and Finishing for storage: As in Example 1, with the sole difference being that prior to being rolled down, the strand sections were each sprinkled with 0.2 g of finely ground, dry cigarette tobacco scraps, so that the ground tobacco was rolled into the artificial tobacco strips. The surface area of the strips was then 36 sq. cm instead of 30 sq. cm.

In all of the foregoing examples, the width of the strand sections was determined by the width of the die opening. In Examples 2, 3, 4, 6, and 9, the width of the strand sections was smaller than their length. In these examples, the strand sections were rotated through an angle of 90° prior to entering the nip of the squeeze rollers, so that they entered the nip with their longer edge first, i.e., with the longer edge parallel to the axes of the squeeze rollers.

TABLE

| | EXAMPLE | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|---|
| A | Pressure for extrusion, in atmospheres above ambient pressure | 80 | 150 | 50 | 90 | 90 | 100 | 80 | 90 | 100 | 80 | 80 | 90 | 80 | 80 | 80 | 80 | 80 |
| | Dimensions of the moist strand sections: | | | | | | | | | | | | | | | | | |
| B | Thickness (mm) | 1.2 | 0.4 | 2.0 | 0.8 | 1.0 | 0.6 | 1.2 | 1.0 | 0.7 | 0.8 | 0.5 | 0.8 | 0.5 | 0.5 | 1.0 | 1.0 | 1.2 |
| C | Width (mm) | 30 | 15 | 10 | 20 | 90 | 45 | 40 | 50 | 20 | 70 | 30 | 70 | 30 | 30 | 30 | 60 | 30 |
| D | Length (mm) | 20 | 20 | 20 | 70 | 20 | 90 | 20 | 30 | 90 | 20 | 15 | 20 | 20 | 20 | 15 | 20 | 20 |
| E | Weight (g) | 0.6 | 0.1 | 0.33 | 0.93 | 1.5 | 2.0 | 0.9 | 1.4 | 1.1 | 1.0 | 0.2 | 1.0 | 0.3 | 0.3 | 0.43 | 1.0 | 0.6 |
| F | Moisture content (weight percent) after pre-drying | 27 | no | 26 | no | no | no | no | 33 | 33 | no | no | no | 36 | 36 | no | no | 27 |
| G | Thickness of rolled-down strips (mm) | 0.24 | 0.15 | 0.30 | 0.20 | 0.19 | 0.25 | 0.22 | 0.23 | 0.15 | 0.20 | 0.17 | 0.2 | 0.15 | 0.15 | 0.2 | 0.2 | 0.24 |
| H | Surface area of rolled-down strips ($cm^2$) | 30 | 8 | 13.2 | 56 | 95 | 97 | 44 | 63 | 84 | 56 | 13 | 56 | 19.5 | 19.5 | 22.4 | 66 | 36 |
| I | Moisture content (weight percent) after drying of the rolled-down strips | 1 | 14 | 4 | 1 | 10 | 2 | 1.5 | 12 | 14 | 13 | 12 | 14 | 1 | 1 | 1 | 11 | 1 |
| J | Moisture content (weight percent) after remoistening of the dried strips | 10 | no | 14 | 13 | no | 12 | 12 | no | no | no | no | no | 12 | 12 | 12 | no | 10 |
| K | Color of the finished artificial tobacco strips | | | | | light brown | | | | | dark brown | light brown | light yellow | dark beige | | light brown | | |

Variations can, of course, be made without departing from the spirit and scope of the invention.

Having thus described the invention, what is desired to be secured by Letters Patent and hereby claimed is:

1. A method for making artificial tobacco comprising forming a substantially homogenous moist composition containing finely divided plant material and additives and having a moisture content of from about 20 to 50 percent by weight, kneading said composition at a pressure of about 50 to 150 atmospheres and extruding said composition through a die to form a substantially uniform strand, continuously dividing said strand immediately after formation thereof into strand sections of substantially equal length, the amount of finely divided plant material contained in said moist composition and the size of said strand sections being so selected that the amount of artificial tobacco contained in each strand section corresponds to a predetermined quantity of about 0.1 to 2.0 grams within a tolerance of ±10 percent, immediately rolling down said strand sections by passing each of said sections between a pair of squeeze rollers rotating at different circumferential speeds and being urged out of mutual linear engagement of their circumferential surfaces by the strand section entering therebetween to thereby form a narrow nip of predetermined width, to thereby form individual rolled down artificial tobacco strips having a surface area of from about 8 to 100 sq. cm.

2. The method of claim 1 where said moist composition is extruded through a plurality of dies of substantially uniform cross section so as to form a plurality of strands.

3. The method of claim 1 wherein the continuously extruded strand emerging from the die is separated into strand sections by successive cutting of the strand by a blade which intermittently passes across the die opening.

4. The method of claim 1 wherein the strand sections are formed such that their longest dimension is from about 20 to 90 mm and wherein said sections are fed to the nip of the squeeze rollers with their longest dimension being parallel to the axes of the squeeze rollers.

5. The method of claim 4 wherein the longest dimension of said sections corresponds to the distance between successive sections, and wherein each strand section, prior to passage through the squeeze rollers is oriented such that the longest dimension is parallel to the squeeze roller axes.

6. The method of claim 1 wherein the mass of artificial tobacco in a strand section is unevenly distributed therein in the direction parallel to the squeeze roller axes as the strand section enters the squeeze roller nip, whereby intermediate portions of said section contain a smaller amount of artificial tobacco than adjacent portions, to thereby obtain curly artificial tobacco having enhanced filling capacity.

7. The method of claim 1 wherein said strand sections, prior to passage between said squeeze rollers, are at least partially coated with dry, finely divided plant material, so that upon passage of said sections between said squeeze rollers said finely divided plant material is rolled into the resulting artificial tobacco strip.

8. The method of claim 1 wherein the strand sections, prior to being rolled down between the squeeze rollers, are pre-dried.

9. The method of claim 1 wherein the rolled down artificial tobacco strips are dried to a moisture content of from about 1 to 4 percent by weight and are subsequently remoistened to a content of from about 10 to 14 percent by weight.

10. The method of claim 1 wherein said moist composition contains water.

11. The method of claim 1 wherein said moist composition contains an organic solvent.

12. The method of claim 1 wherein said moist composition additionally comprises a binder, a burning aid, an aromatizing agent, a brightness, or an adsorbent, or mixtures thereof.

* * * * *